United States Patent [19]

Takahashi

[11] 4,390,175

[45] Jun. 28, 1983

[54] RECORDING MEDIUM FEEDING DEVICE

[75] Inventor: Yuji Takahashi, Tokyo, Japan

[73] Assignee: Canon Kabushiki Kaisha, Tokyo, Japan

[21] Appl. No.: 233,097

[22] Filed: Feb. 10, 1981

[30] Foreign Application Priority Data

Feb. 18, 1980 [JP] Japan ..... 55-18823

[51] Int. Cl.[3] ..... B65H 1/18

[52] U.S. Cl. ..... 271/157; 221/14; 271/126; 271/164; 271/215; 271/155

[58] Field of Search ..... 271/157, 164, 163, 162, 271/152, 153, 154, 155, 156, 126, 215, 217; 221/14, 227; 414/118, 119, 100

[56] References Cited

U.S. PATENT DOCUMENTS

| | | | |
|---|---|---|---|
| 2,707,142 | 4/1955 | Waite | 271/154 X |
| 3,378,254 | 4/1968 | Eichorn | 271/155 |
| 4,231,565 | 11/1980 | Ichikawa et al. | 271/164 X |
| 4,231,566 | 11/1980 | Suzuki | 271/164 X |
| 4,273,323 | 6/1981 | Kaneko et al. | 271/164 X |

FOREIGN PATENT DOCUMENTS 3017329 11/1980 Fed. Rep. of Germany ..... 271/9

OTHER PUBLICATIONS

Bishop, J. L. et al., "Paper-Stack Height Control," *IBM Tech. Disc. Bull.,* vol. 20, No. 5, Oct. 1977, p, 1691.

*Primary Examiner*—Bruce H. Stoner, Jr.
*Attorney, Agent, or Firm*—Fitzpatrick, Cella, Harper & Scinto

[57] ABSTRACT

A recording medium feeding device for use in an image formation instrument such as a printer, a copying apparatus or a recording apparatus. The feeding device has a recording medium supporting table, feed apparatus for feeding the recording mediums on the supporting table, and a drive system for vertically driving the supporting table. During supply of recording mediums, the supporting table is gradually lowered from a predetermined upper position as the recording mediums are supplied.

8 Claims, 11 Drawing Figures

RECORDING MEDIUM FEEDING DEVICE

BACKGROUND OF THE INVENTION

1. Field of the Invention

This invention relates to a recording medium feeding device useable in an image formation instrument which facilitates the operation of supplying recording mediums to the recording medium feeding device for supporting a great deal of recording medium thereon. Particularly, it relates to a recording medium feeding device which facilitates the operation of supplying recording mediums thereto, thereby enabling the recording mediums to be supplied in good order.

2. Description of the Prior Art

A conventional feeding device will hereinafter be described by taking as an example the recording medium feeding device of a high-speed copying apparatus.

Some of the recent high-speed copying apparatus have a copying capacity of 100 or more sheets of A4 size recording medium (formed, for example, of paper or resin and hereinafter referred to as the transfer medium) per minute. In such high-speed copying apparatus, a great deal of the transfer medium is consumed in a short time and therefore, a great deal of transfer medium (for example, 3,000 to 5,000 sheets) must be contained in the transfer medium feeding device of the apparatus and thus, it is necessary to increase the capacity of the feeding device.

Therefore, in the conventional feeding device, the transfer medium supporting portion thereof has been made deeper and larger so as to be capable of supporting and containing a great deal of transfer medium therein. However, having transfer mediums piled in good order on such deeper or larger supporting portion is difficult and cumbersome because it is difficult for the operator to put his hands into the interior of the supporting portion. Therefore, it has often been the case that transfer mediums are piled on the supporting portion without the ends of the transfer mediums being properly arranged or transfer mediums are piled with the end of the lowermost transfer medium being curled and floated, and this has prevented the transfer mediums from being well fed and has caused jamming or oblique movement of transfer mediums or feeding of multiple transfer mediums at a time.

SUMMARY OF THE INVENTION

It is an object of the present invention to provide a transfer medium feeding device in which the operation of supplying transfer mediums is improved.

It is another object of the present invention to provide a transfer medium feeding device in which a great deal of transfer medium can be stacked and contained easily in good order.

The feeding device of the present invention has a transfer medium supporting table, drive means for vertically driving the supporting table, and control means for controlling the drive means so that, during supply of transfer mediums, the supporting table is gradually lowered from a predetermined position as the transfer mediums are supplied. The supporting table is designed to be gradually lowered as transfer mediums are supplied.

Therefore, in the transfer medium feeding device according to the present invention, the supporting table or the surface of the topmost one of the transfer mediums on the supporting table is always positioned at an upper location during supply of transfer mediums, so that transfer mediums can be supplied in good order.

The invention will become more fully apparent from the following detailed description thereof taken in conjunction with the accompanying drawings.

DESCRIPTION OF THE PREFERRED EMBODIMENTS

The present invention will be described in greater detail with respect to an embodiment thereof which is applied to a copying apparatus.

Figure 1:
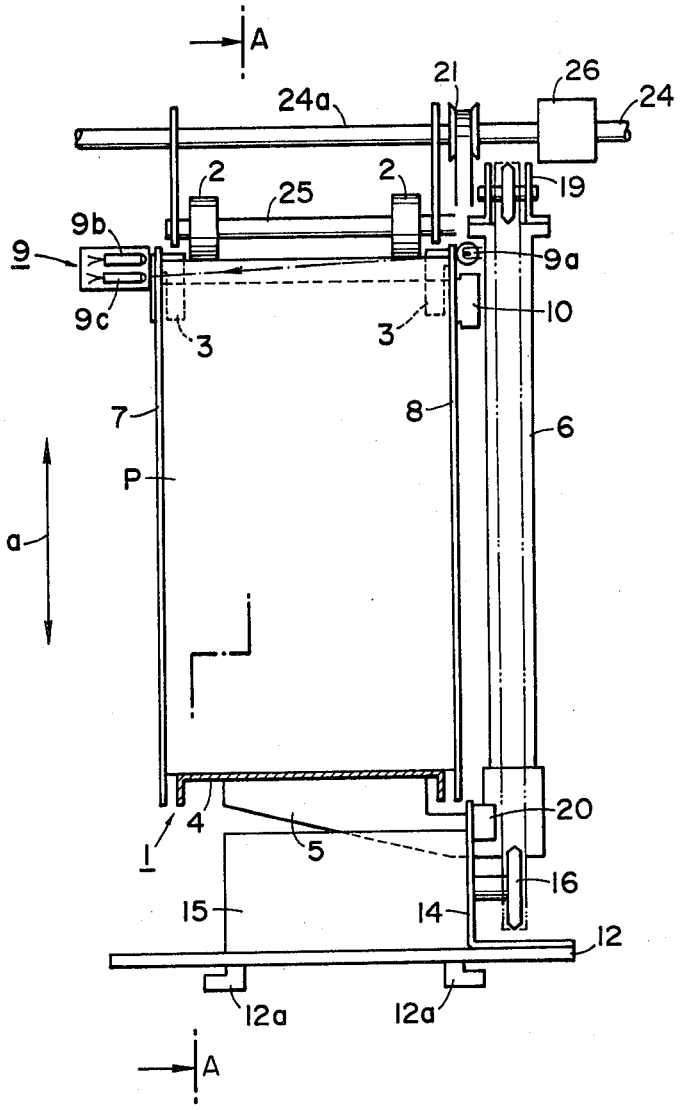
FIG. 1 is a front view of a feeding device using an embodiment of the present invention.
Figure 2:
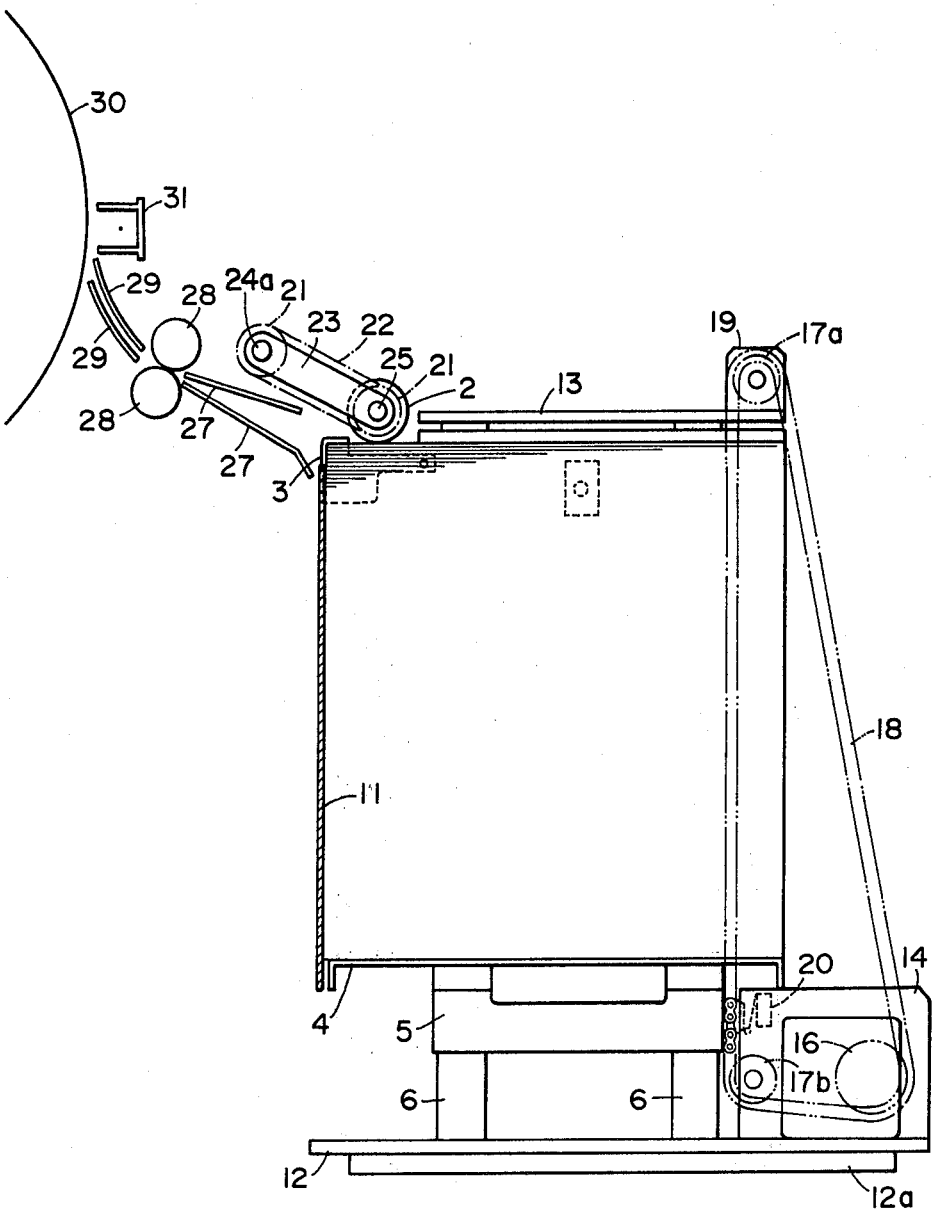
FIG. 2 is a cross-sectional view of the device taken along line A—A of FIG. 1.
Figure 3:
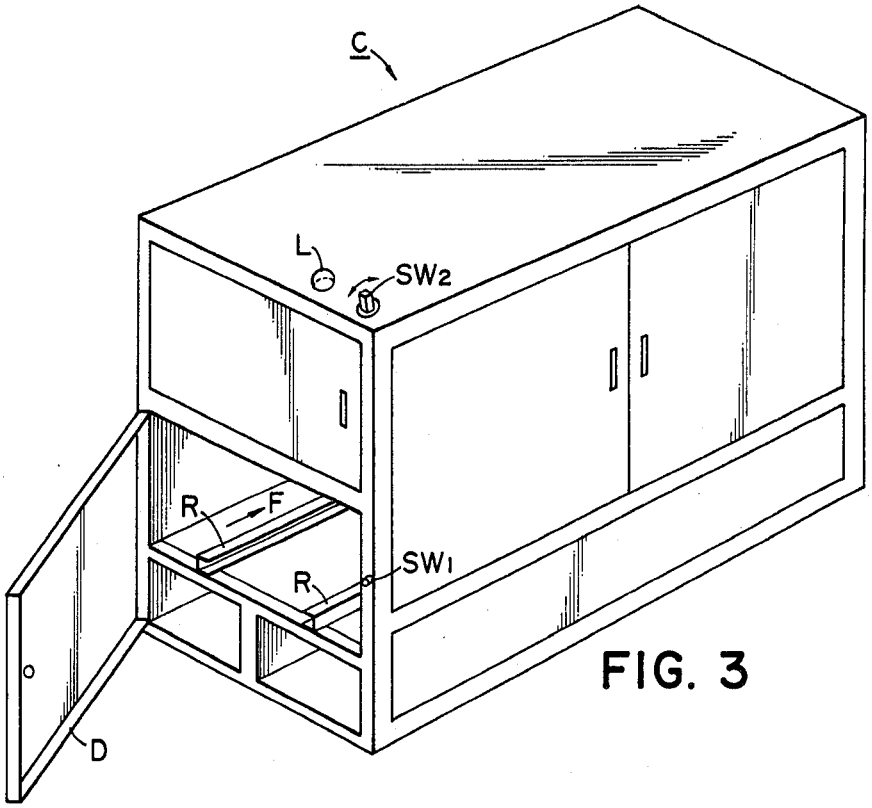
FIG. 3 is a perspective view of a copying apparatus in which the feeding device is incorporated.
Figure 4:
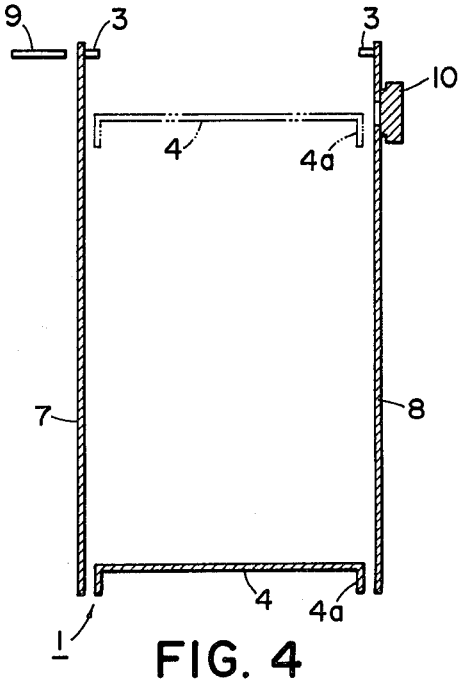
FIGS. 4, 5 and 6 illustrate the principle of operation of an embodiment of the present invention.

FIG. 1 is a front view of a feeding device using an embodiment of the present invention, and FIG. 2 is a cross-sectional view taken along line A—A of FIG. 1. FIG. 3 is a perspective view of a copying apparatus having this feeding device incorporated therein.

In these Figures, reference numeral 1 designates a feeding deck on which 2,000 to 3,000 cut sheets P can be supported. Designated by 2 are feed rollers provided on the copying apparatus body side and formed of a material of high friction coefficient such as rubber or the like. The feed rollers 2 make contact with the topmost cut sheet P on the deck 1 by their gravity and may be rotated by receiving a feed signal (not shown), thereby feeding the cut sheet P. The feed rollers 2 are fixed to a paper feed shaft 25 and a timing pulley 21 is mounted on one end of the paper feed shaft 25. On the other hand, rotation of the feed rollers 2 is effected by rotation of a drive shaft 24 rotated by unshown drive means being transmitted to a drive shaft **24*a* through a clutch 26 and further transmitted from a timing pulley 21 mounted on the drive shaft 24*a* to timing pulley 21 on the paper feed shaft 25 by a timing belt 22. Designated by 3 are separating pawls provided on the feeding side end to separate, one by one, transfer mediums moved up along a guide 11 before feeding. The transfer medium fed from the deck 1 by the rotation of the feed rollers 2 and the separating pawls 3 passes along a guide 27 and is fed until it bears against register rollers 28, stationary at this time to form a suitable loop in the transfer medium. The rollers 28 are then rotated to feed the transfer medium further along a guide 29 in synchronism with the image on a photosensitive drum 30, whereby an image is formed on the transfer medium through a transfer charger 31, whereafter the transfer medium is discharged from the copying apparatus body C. Designated by 4 is the stage of the deck 1 which is mounted for movement in a vertical direction (direction of arrow a) with transfer mediums P stacked thereon. This stage 4 may be vertically moved by a lifter 5. The lifter 5 is vertically movable while being guided by two guide shafts 6 connected between a bottom plate 12 and a top plate 13. A guide 12***a* slidable on the rail R on the body side (FIG. 3) is provided at the bottom of the bottom plate 12. One end of the lifter 5 is connected to a drive chain 18. The chain 18 is passed over a drive sprocket 16 and idler sprockets 17*a*, 17*b*, so that the stage 4 is vertically moved in accordance with the direction of rotation of a motor 15. The motor 15 is mounted on a mounting plate 14 and fixed onto the bottom plate 12. On the mounting plate 14, the idler sprocket 17*b* is provided by means of a plate, not shown, to enable the tension of the chain 18 to be adjusted. Also provided on the mounting plate 14 is a microswitch 20 which may be actuated by an unshown cam plate mounted on the lifter 5, to thereby detect that the lifter 5 has come to its lower limit position. A bracket 19 for supporting the idler sprocket 17*a* is provided on the top plate 13. During operation of the copying apparatus, the lifter 5 is lifted to a feeding position whereat a sensor 9 is provided and in which the feed rollers 2 always bear against the top-most transfer medium P. Designated by 7 and 8 are side plates which regulate the opposite side edges of the transfer mediums P.

Now, the replenishment of transfer mediums according to the present embodiment will be described.

Description will first be made of a case where transfer mediums have been exhausted and transfer mediums are replenished.

In the case of the present embodiment, the sensor 9 comprises a lamp 9*a* and light-receiving elements 9*b*, 9*c* and when transfer mediums P become exhausted, the light from the lamp 9*a* passes through a cut-away portion provided in the stage 4 and reaches the light-receiving element 9*c*. By this, the sensor 9 detects the absence of transfer mediums, whereupon the transfer medium supply lamp L of the copying apparatus body C flickers. On the other hand, the sensor 9*b* is used to determine the level of the paper during normal paper feeding. That is, the stage is lifted to a position whereat the output of the sensor 9*b* is turned off by the light from the lamp 9*a*, and is stopped at that position. When the level of the paper is lowered with paper feeding to permit the light to again reach the sensor 9*b*, the stage is again lifted until the light is intercepted. Thereupon, for example, when the operator opens the door D of the copying apparatus body to draw out the deck 1 along the rail R on the copying apparatus body C side, a replenishing switch SW1 is closed to produce a supply signal, by which the motor 15 is driven in the direction opposite to the direction of rotation during operation of the copying apparatus and the stage 4 is lowered to the level of a sensor 10. This sensor 10 is provided, for example, about 50 mm below the transfer medium feeding position and therefore, a space of about 50 mm is provided between the stage 4 and the feed rollers 2 (FIG. 1). Thereupon, new transfer mediums P1 are supplied into this space with their ends properly arranged. In that case, the stage 4 has already been lifted to a predetermined level whereat the sensor 10 is provided and therefore, the operator can readily stack the transfer mediums on the stage 4 without putting his hands into the interior of the deck 1.

Figure 5:
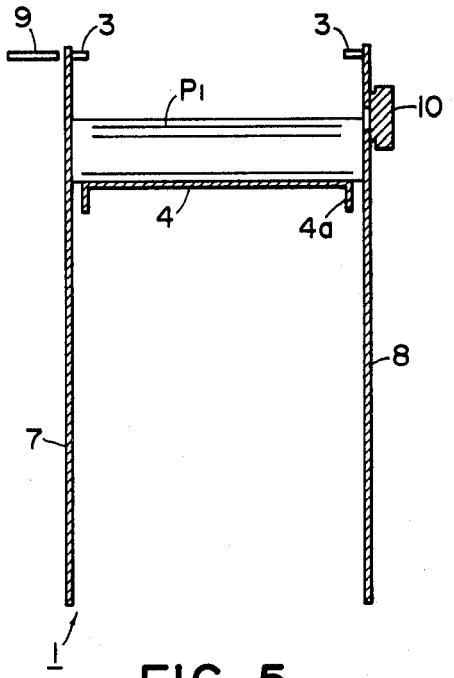
Figure 6:
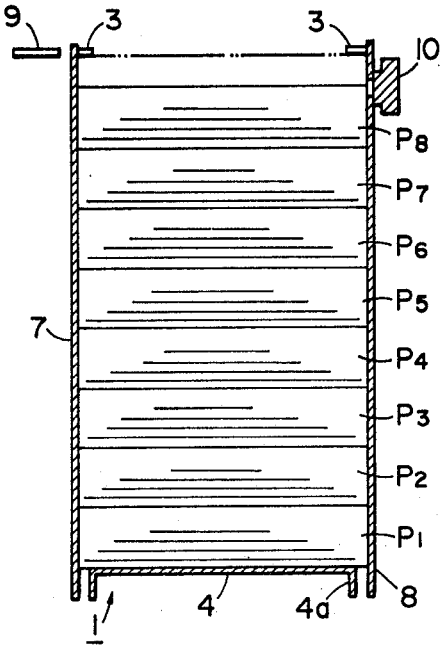

Next, when transfer mediums P1 are supplied onto the stage 4, the sensor 10 detects the supplied transfer mediums P1 and a supply signal is again produced to drive the motor 15, which lowers the stage 4 until the topmost surface of the supplied transfer mediums P1 comes to the level of the sensor 10 (FIG. 5). In this case, in order to ensure stacking of the transfer mediums, the motor is driven with a predetermined time delay (for example, about 10 seconds) after the transfer mediums have been detected, whereby the stage 4 is lowered. FIG. 6 shows a condition in which this operation has been repeated eight times, that is, a condition in which, assuming that a bundle of about 500 sheets of transfer medium (P1–P8) is supplied per once, 4,000 sheets (500 sheets×8 bundles) of transfer medium have been supplied. When the supply of transfer mediums onto the deck 1 is thus terminated, the deck 1 is pushed into a predetermined position within the copying apparatus body C and the door D of the copying apparatus body C is closed. By the door D being closed, the supply switch SW1 is opened and the supply signal is discontinued and therefore, the motor is rotatively driven in the same direction as that during operation of the copying apparatus, so that the stage 4 is lifted to the feeding position in which the topmost transfer medium bears against the feed rollers 2. Thus, the supply of transfer mediums is terminated and the copying apparatus becomes ready to effect copying.

Figure 7:
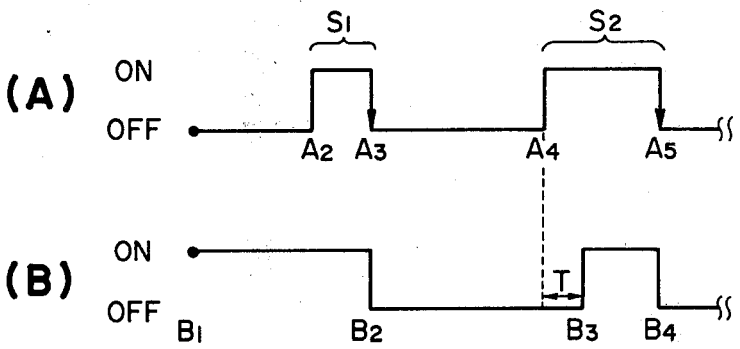
FIG. 7 shows the driving timing of a sensor and a motor.

Reference is now had to FIG. 7 to describe the drive timing of the sensor 10 and the motor which drives the lifter 5.

FIG. 7A shows the drive timing of the sensor 10, and FIG. 7B shows the drive timing of the motor 15. From B1 to B2, the motor 15 remains energized in response to the supply signal from the replenishing switch SW1 which is produced by the door D being opened, and lowers the stage 4 until the upper surface of the stage 4 reaches the detecting position of the sensor 10. At this time, the sensor 10 is switched on during the passage of the bent portion 4*a* of the stage 4(A2–A3), and stops driving the motor 15 after said passage (point B2). The sensor 10 remains in OFF condition from A3 to A4 and during this time, supply of transfer mediums is effected and at a time point A4, detection of the supplied transfer mediums is effected, and then the motor 15 is driven with a suitably adjusted predetermined time delay (indicated by T1 the driving of the motor is started at a point B3) to lower the stage 4 until the stacked transfer mediums are not detected by the sensor (at a point A5, the topmost transfer medium reaches the position of the sensor 10). The position resolving power of the sensor 10 used may sufficiently be of the order of 5 mm. If the transfer mediums on the stage 4 are small in quantity and the thickness of the piled sheets is less than the position resolving power, the sensor 10 is incapable of effecting detection and thus cannot control the motor 15. Accordingly, in order that the chart of FIG. 7 may be established, transfer mediums more than a predetermined number of sheets must be stacked. The predetermined number of sheets is usually about 50. However, if the position resolving power of the sensor 10 is enhanced, even a small number of sheets can be detected.

Figure 8:
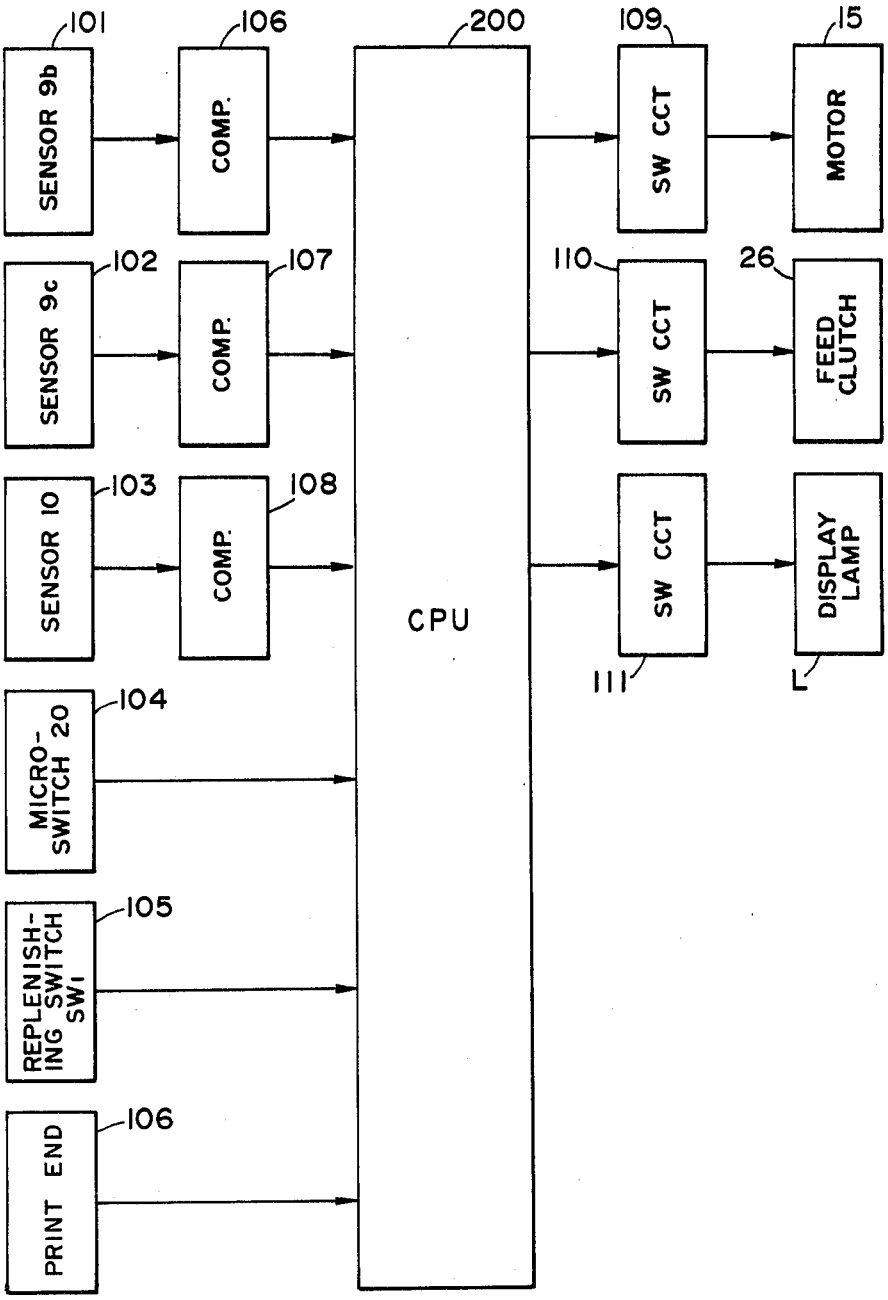
FIG. 8 is a block diagram showing a control circuit.

Now, FIG. 8 is a diagram of a control circuit for causing the feeding device to effect the aforementioned operation, and this circuit is comprised chiefly of a controlling CPU. This controlling CPU is a one-chip microcomputer having a well-known ROM (read only memory), RAM, etc. incorporated therein and may be, for example, μCOM43 (produced by Nippon Denki Co., Ltd). This well-known microcomputer may be provided with a memory containing therein a program corresponding to the flow chart shown in FIG. 9 or 10.

Now, the output signals from a detecting circuit 101 comprising a light-receiving sensor 9*b*, a detecting circuit 102 comprising a light-receiving sensor 9*c* and a detecting circuit 103 comprising a reflection type sensor 10 are compared with a predetermined level of voltage by comparators 106, 107 and 108, respectively, and are transformed into Q values therein and applied as inputs to the controlling CPU200. Also, the signals from a circuit 104 comprising a microswitch 20, a circuit 105 comprising a replenishing switch SW1 and a print end circuit 106 on the body side are applied as inputs to the CPU200. From the CPU200, drive control signals for motor 15 and feed clutch 26 and a turn-on signal for display lamp L are put out through switching circuits 109, 110 and 111.

Figure 9:
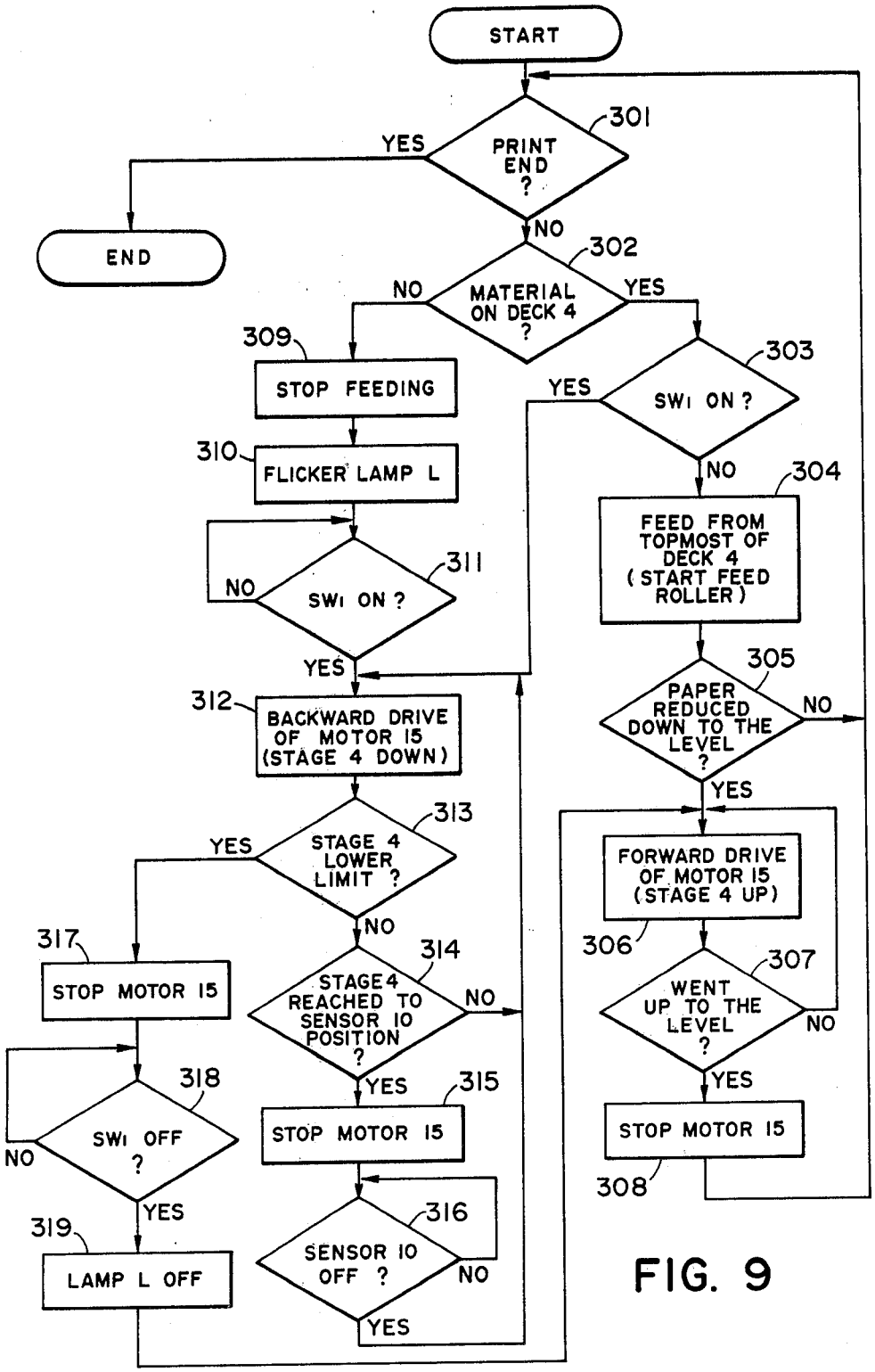
FIG. 9 is a flow chart.

Within this CPU200, a necessary actuator is controlled in accordance with the logic flow shown in FIG. 9. That is, the logic comprises the following steps.

First, at step 301, whether or not the print has been terminated is judged depending on whether or not the print continue signal from the body side is being received, and if the print is being continued, the program proceeds to step 302. At step 302, the presence of transfer mediums is examined by the sensor 9. If transfer mediums are present, the program follows step 303. When transfer mediums are present, the replenishing switch SW1 is not closed unless the door D is opened, and the paper feed of step 304 is effected. If the door D is opened, the replenishing switch SW1 is closed and so, the program proceeds to step 312 and a command for lowering the stage 4 is carried out. On the other hand, when the transfer mediums are decreased in quantity by the paper feed of step 304, the sensor 9*b* comes to receive light and whether or not the quantity of transfer mediums has become less than a predetermined level is judged. If the quantity of transfer mediums is above the predetermined level, the program returns to step 301, thus permitting the feeding to be continued. If the quantity of transfer mediums is less than the predetermined level, the motor 15 is driven in forward direction by steps 306, 307 and 308 until the predetermined level is reached, whereby lifting the stage 4, and the motor 15 is stopped when the predetermined level is reached. On the other hand, when, at step 302, the absence of transfer mediums on the deck 4 is detected by the sensor 9, paper feed is discontinued at steps 309 and 310 while, at the same time, the "no transfer medium" lamp L is caused to flicker. The program waits in a dynamic loop until, at step 311, the replenishing switch SW1 is closed, namely, the door D is opened. Also, by closing of the replenishing switch SW1, the motor 15 is driven in reverse direction at step 312 to lower the stage 4. If, at that time, the microswitch 20 detects, at step 313, that the stage 4 has reached its lower limit position, the program waits in a dynamic loop until the motor 15 is stopped at step 317 and the replenishing switch SW1 is opened at step 318. At this time, supply of transfer mediums onto the deck 4 is effected. If the door D is closed to open the replenishing switch SW1, the flicker of the "no transfer medium" lamp L is turned off and the program enters step 306, thereby lifting the stage again to the predetermined feeding position. If the stage 4 has not reached its lower limit position at step 313, the stage 4 continues to be lowered to a position whereat it is detected by the sensor 10 and, if the stage reaches the position whereat the sensor 10 is disposed, the motor 15 is stopped at step 315. Next, at step 316, the program waits in a dynamic loop until the operator supplies transfer mediums and the output of the sensor 10 is switched off. If the output of the sensor 10 has not been switched off, the stage 4 is again lowered until the topmost transfer medium reaches the position of the sensor 10. This operation is repeated until the stage 4 comes to its lower limit position.

Now, turning back to FIG. 8, the output as the result of the above-described logic judgment drives the motor 15, the feed clutch 26 and the display lamp L through switching circuits 109, 110 and 111.

In the present embodiment, the position whereat the sensor 10 is installed can be suitably adjusted in accordance with the quantity of transfer mediums supplied. Also, the delay time from after the supplied transfer mediums have been detected by the sensor 10 until the motor is driven can be suitably set by taking into consideration the time required to pile the transfer mediums in good order on the stage. Further, the invention is not restricted to this embodiment, but a switch may be provided on a separate body and by actuating this switch after the transfer mediums have been positively supplied, a signal for lowering the lifter 5 may be produced to lower the deck to a predetermined position. The switch in this case may desirably be, for example, a switch of the type which is opened in neutral position and can produce ON signals in both directions and which returns to the neutral position when a hand is released therefrom, instead of a bistable switch such as a conventional toggle switch. This switch is shown as SW2 in FIG. 3. By using this switch SW2, the direction in which the motor 15 is driven can be directly changed depending on the direction in which the switch is thrown down and thus, control of the stage 4 becomes possible without using the sensor 10.

Figure 10:
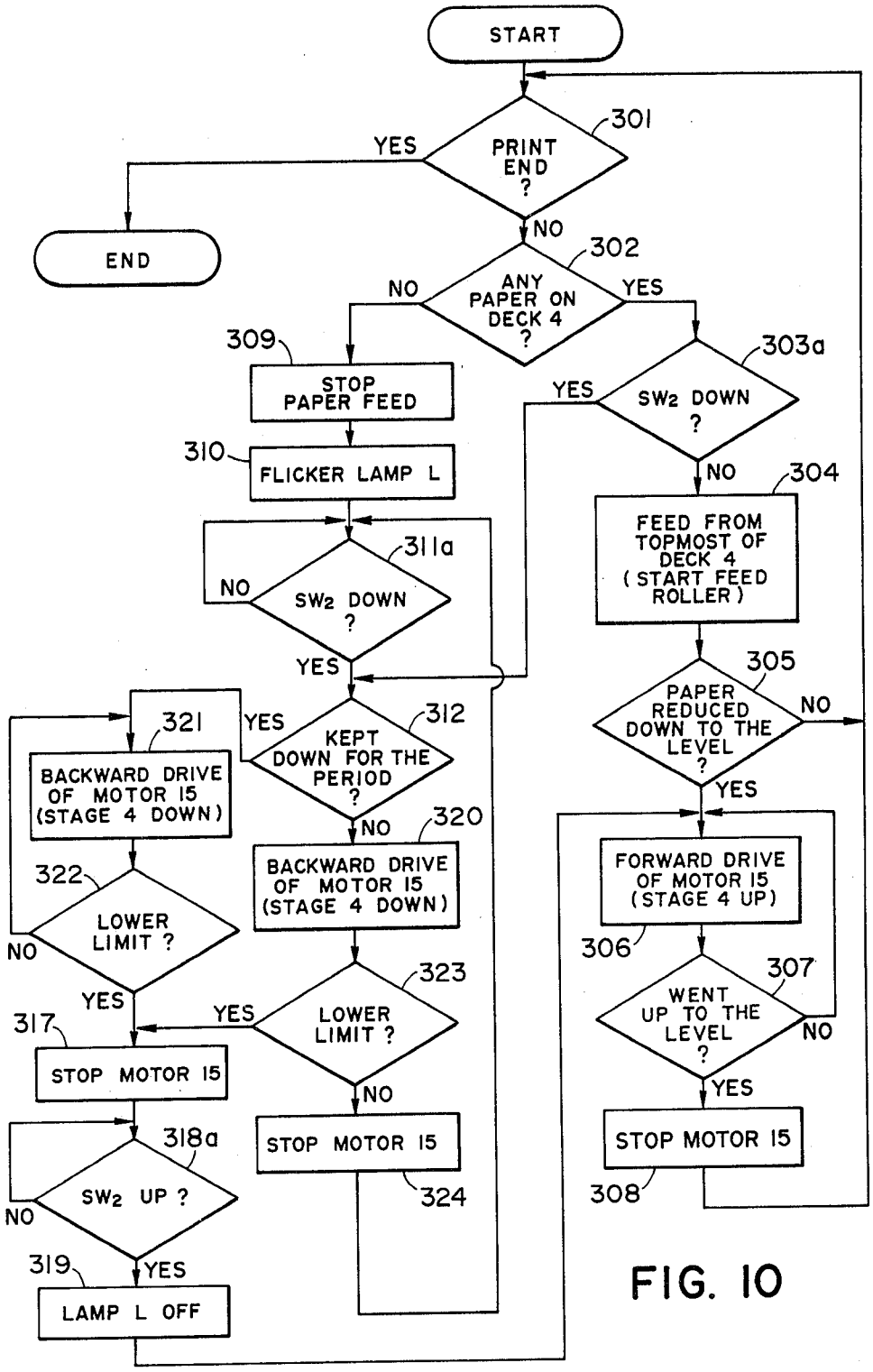
FIG. 10 is a flow chart showing another embodiment.

The flow of logic in this case is shown in FIG. 10. At step 303*a*, whether or not the replenishing switch SW2 (FIG. 3) has been thrown down in DOWN direction is judged. That is, the presence of the lowering instruction for the stage 4 is judged and, if the lowering signal is present, the program branches off to step 312. At step 311*a*, similarly to the example of FIG. 9, the program waits in a dynamic loop to see whether or not the replenishing switch SW2 has been thrown down. Further, at step 312, whether the replenishing switch SW2 is being actuated temporally or continuously is judged and, when it has been actuated temporarily, the motor 15 is driven in reverse direction for a predetermined time by step 320 and the stage 4 is lowered correspondingly to said time. The stage is lowered a predetermined distance by steps 320, 323 and 324, whereby the operator supplies transfer mediums onto the lowered stage 4, whereafter the program returns to step 311*a* until the stage 4 reaches its lower limit position, whereupon this operation is repeated. On the other hand, at step 321, when the replenishing switch SW2 is continuously thrown down for more than a predetermined time, the motor 15 is continuously supplied with power during the time that the replenishing switch SW2 is thrown down, thereby lowering the stage 4. When the stage 4 has been lowered to a desired position, the switch SW2 is thrown up to stop the stage 4, whereupon supply of transfer mediums is effected. Or alternatively, the stage 4 may be lowered to its lower limit position, namely, to the detecting position of the microswitch 20. This is shown in step 322. When the stage 4 has reached its lower limit position, the motor 15 is stopped at step 317. Hereupon, supply of transfer mediums is effected. Further, at step 318, the replenishing switch SW2 is thrown up, whereby the "no transfer medium" lamp L is turned off at step 319.

Figure 11:
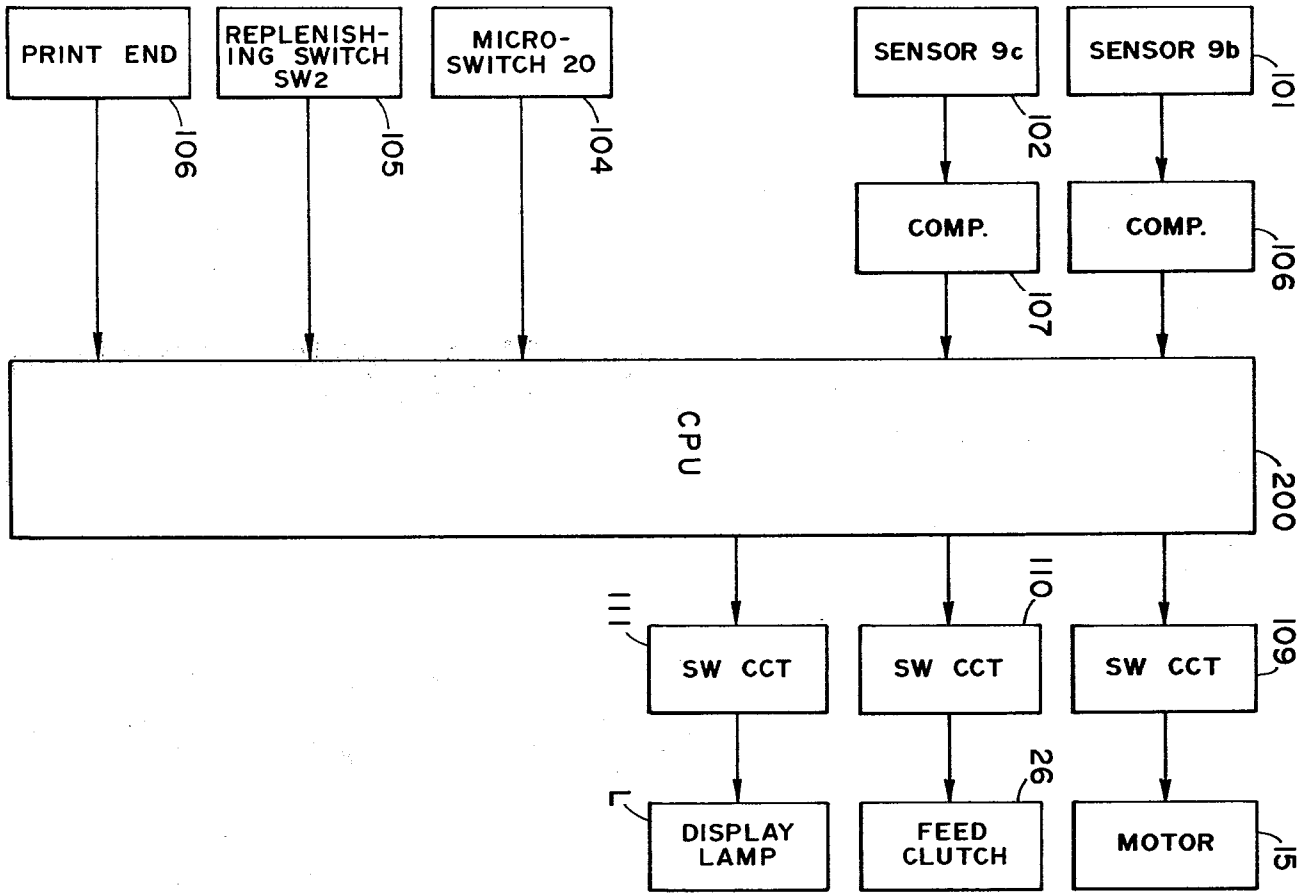
FIG. 11 is a block diagram showing the control circuit in the embodiment of FIG. 10.

FIG. 11 diagrammatically shows the control circuit of the present embodiment. It is similar to the circuit of FIG. 8 except that the sensor 10 is eliminated and that the replenishing switch has been changed to a switch SW2 of the type which can assume two input conditions of UP/DOWN.

The present invention, as has been described above, is characterized in that, during supply of transfer mediums, the transfer medium supporting table is gradually lowered from its upper predetermined position as the transfer mediums are supplied. Thus, transfer mediums can be supplied at a predetermined level and accordingly, reliably and in good order.

What I claim is:

1. A recording medium feeding device usable with an image formation apparatus, comprising:

a recording medium stacking table;

feed means for feeding recording mediums from said stacking table;

drive means for raising and lowering said stacking table between a feeding position and a lower limit position; and control means for controlling said drive means to lower said table to a stand-by position between its feeding position and its lower limit position in response to a first signal indicating that a supply of recording mediums is required on said stacking table, and to raise said stacking table to its feeding position in response to a second signal indicating that said stacking table is supplied with recording mediums.

2. A device according to claim 1, wherein means are provided for controlling said control means in response to opening of a door of the image formation apparatus body.

3. A device according to claim 1, wherein means are provided for controlling said control means whereby said stacking table is lowered to the position of a sensor provided at a predetermined position between the feeding and limit positions of said stacking table.

4. A device according to claim 3, wherein said control means is adapted to lower the topmost surface of the supplied recording mediums stacked on said supporting table to the position of said sensor.

5. A device according to claim 1, wherein on ON-OFF switch is provided to control said control means.

6. A device according to claim 1, wherein the lowering of said stacking table is terminated by detecting the lower limit position thereof.

7. A device according to claim 1, wherein said drive means includes a motor which is driven in forward direction or reverse direction by said control means.

8. A device according to claim 1, wherein said first signal is generated in response to movement of a door on the image formation apparatus.

* * * * *